United States Patent [19]

Clutts

[11] 4,369,526

[45] Jan. 25, 1983

[54] UTILITY VEST

[76] Inventor: Earnest H. Clutts, 3906 Venus Cir., Huntsville, Ala. 35810

[21] Appl. No.: 194,927

[22] Filed: Oct. 8, 1980

[51] Int. Cl.[3] ..... A41D 13/04

[52] U.S. Cl. ..... 2/51; 2/70; 2/94; 2/102

[58] Field of Search ..... 2/51, 48, 50, 94, 70, 2/102, 93

[56] References Cited

U.S. PATENT DOCUMENTS

| | | | |
|---|---|---|---|
| 2,066,072 | 12/1936 | Powell | 2/51 |
| 2,670,470 | 3/1954 | Manheim et al. | 2/70 |
| 2,705,805 | 4/1955 | Weinberg | 2/93 |
| 3,105,241 | 10/1963 | Allen | 2/94 |
| 3,529,307 | 9/1970 | Belson et al. | 2/94 |
| 3,535,709 | 11/1970 | Johannes | 2/51 |
| 4,106,121 | 8/1978 | Belson | 2/102 |

FOREIGN PATENT DOCUMENTS

| | | | |
|---|---|---|---|
| 554520 | 1/1957 | Italy | 2/70 |

*Primary Examiner*—H. Hampton Hunter
*Attorney, Agent, or Firm*—Finnegan, Henderson, Farabow, Garrett & Dunner

[57] ABSTRACT

A utility vest for worker's tools and supplies includes a canvas utility apron detachably secured by a heavy-duty zipper around the bottom of a sleeveless nylon vest. The utility apron has leather pouches detachably secured to it by zippers at desired locations. The leather pouches are of various shapes and sizes to hold various tools and supplies depending on the occupation of the user. The zippers for securing the various pouches to the apron are of identical construction so that any given pouch may be secured at any desired location around the apron. A buckle on the apron beneath the heavy-duty zipper eliminates excessive strain on the main vest zipper caused by the weight of the tools and supplies. The utility vest is designed to allow a worker to wear a short coat over the top of the vest in colder weather while still permitting easy access to the tools and supplies on the utility apron.

6 Claims, 2 Drawing Figures

UTILITY VEST

BACKGROUND OF THE INVENTION

The invention relates generally to utility vests for workers, such as construction workers, providing variable tool-carrying capabilities.

The need of construction workers, electricians, repairmen, carpenters, and other workers requiring a number of various tools at their fingertips for a working garment providing tool-storage capabilities has long been recognized. Many efforts have been made in the prior art to provide such a garment, but each suffers from one or more deficiencies in its design. Exemplary of prior art efforts to provide utility garments are U.S. Pat. No. 2,066,072 issued Dec. 29, 1936 to Powell; U.S. Pat. No. 3,529,307 issued Sept. 22, 1970 to Belson et al; U.S. Pat. No. 3,105,241 issued Oct. 1, 1963 to Allen; U.S. Pat. No. 3,535,709 issued Oct. 27, 1972 to Johannes; and U.S. Pat. No. 4,106,121 issued Aug. 15, 1978 issued to Belson.

Powell, for example, discloses a carpenter's garment in the form of a vest which includes ventilating openings. Pouches or straps for the receipt of tools and the like may be disposed about the lower periphery of the vest, the vest being said to equalize the weight of the tools on the shoulders and across the back. Powell's vest may be closed by a zipper and may include breast pockets and a pencil pocket.

Belson discloses a tactical load-bearing vest which snugly fits the body so that the weight of supplies carried by the vest is distributed over a wider portion of the torso rather than concentrated on the shoulders of the wearer. Vest openings are shaped to provide optimum ventilation, and padding is provided in the shoulder and waist area to alleviate chafing. The supply pouches are removably attached to the vest, and other carrying pouches differing in purpose and detail may be employed. Pouches may be secured along the lower periphery of the vest.

Allen discloses a shooting vest including an auxiliary belt fixed about the waist of the garment to which flat pocket panels are attached in a manner allowing support of the weight of the items carried in the pockets without distributing that weight to the shoulder portions of the garment.

The Powell, Benson and Allen teachings are exemplary of prior-art efforts to provide a vest-like garment containing tool-storage pouches. These are to be contrasted with more traditional attempts to solve the tool-storage problem by use of a utility apron similar to that illustrated by Johannes. Prior-art utility vests pose a number of problems, including storage of the tools at locations far removed from the point of use, awkward load distribution, and hindrance of access to tool storage when weather conditions require the user to wear an outer garment. Prior-art utility aprons, on the other hand, have traditionally provided tool storage in locations susceptible to spilling of the contents during bending or squatting or likely to result in breakage of the contents during lifting of heavy objects. Both prior-art vests and prior-art aprons can cause red or irritated skin resulting from wrinkles in clothing being pressed against the skin.

It is an object of the present invention to provide a utility vest, not with attached pockets as in the prior art, but with an attached apron disposed about its lower periphery in such a manner that the problems of both prior-art vests and prior-art aprons are largely alleviated.

The present invention provides a utility vest for workers, such as construction workers, that eliminates red or irritated skin resulting from wrinkles in clothing being pressed against the skin by work belts of standard work aprons.

The present invention further provides a utility vest for construction workers, or the like, that eliminates the strain on the hips and small of the back caused by the weight of standard work aprons.

The present invention further provides a utility vest for construction workers, or the like, that distributes the weight of a work apron evenly across the top of the shoulders.

The present invention further provides a utility vest for construction workers, or the like, that can be worn in all weather conditions with easy access to tools.

The present invention further provides a utility vest for construction workers, or the like, wherein utility tool pouches are not bulging in front of the worker, wherein items carried in the pouches are not spilled when the worker is bending or squatting, and wherein pencils and marking crayons are not broken when lifting heavy objects against the body.

SUMMARY OF THE INVENTION

The utility vest of the present invention comprises a sleeveless vest made of a lightweight strong material having an integral body comprising a back panel, two side panels, two front panels, and a shoulder panel connecting each front panel to the back panel; front panel closing means connected to the front panels for attaching and detaching the front panels of the vest; a utility apron made of a cloth material; utility apron connecting means located beneath the front panel closing means and attached to and around the lower periphery of the vest panels and to the top of the utility apron for detachably connecting the utility apron to and around the lower periphery of the vest panels; a plurality of pouches adapted to hold tools and supplies of various kinds; pouch connecting means attached to the utility apron at desired locations and to the top of each pouch for detachably and interchangeably connecting each pouch to the utility apron at the desired locations; and buckle means located beneath the utility apron connecting means and attached to each end of the utility apron for detachably securing the ends of the utility apron.

Preferably, the sleeveless vest is made of nylon, the utility apron is made of canvas, and the pouches made of leather. It is also preferred that heavy-duty zippers be used as the utility apron connecting means and pouch connecting means.

DESCRIPTION OF THE PREFERRED EMBODIMENT

Figure 2:
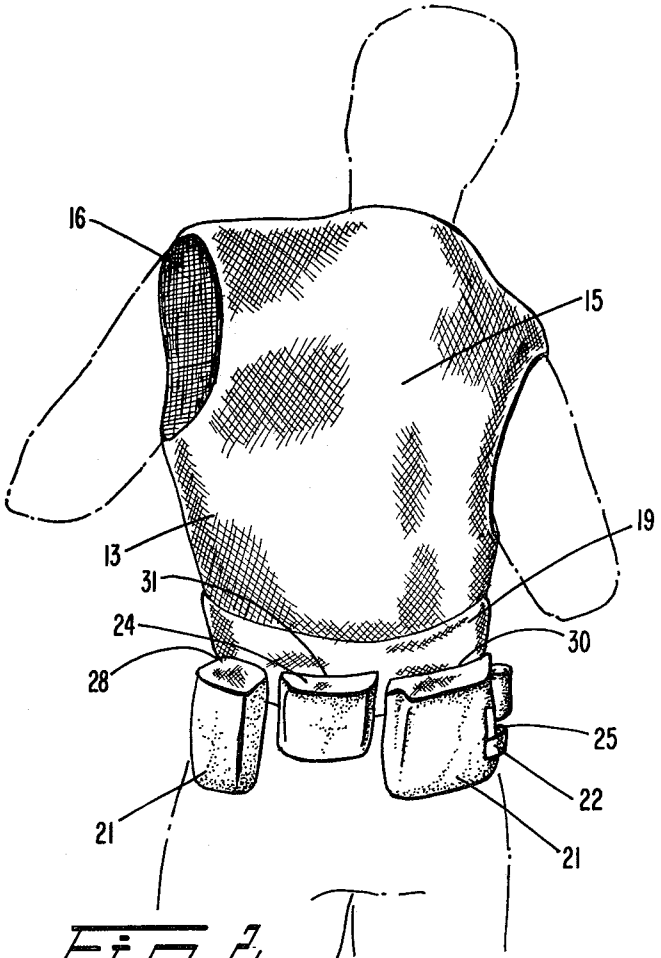
FIG. 2 is a rear view of the utility vest of the present invention.
Figure 1:
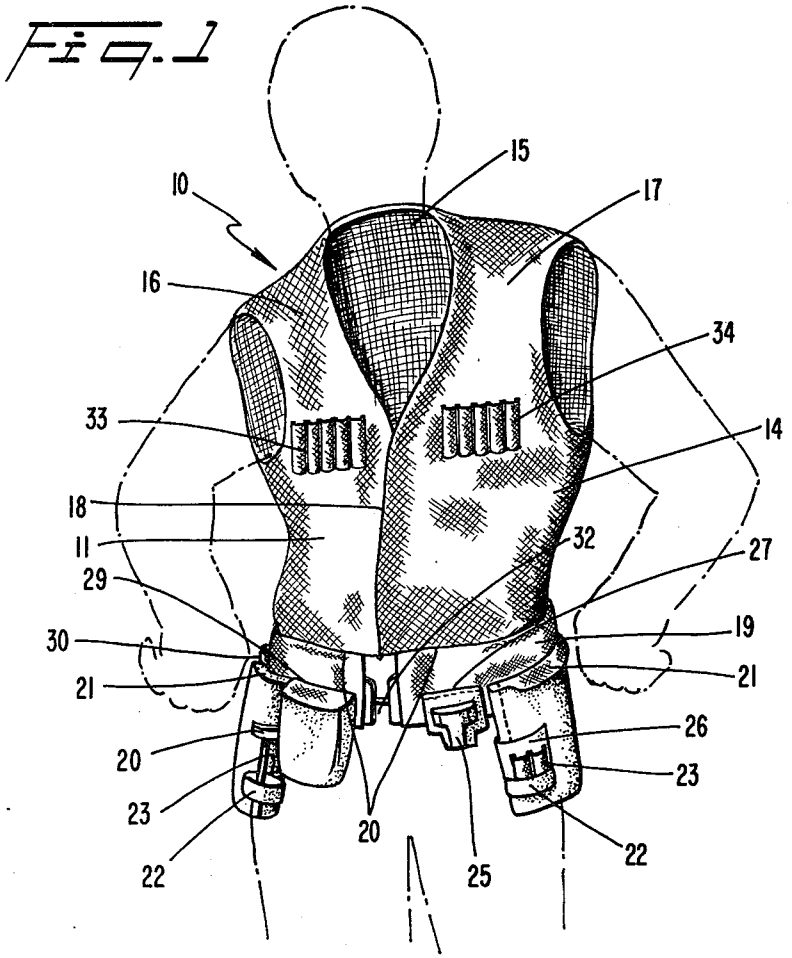
FIG. 1 is a front view of the utility vest of the present invention.

Referring to FIGS. 1 and 2, there is shown one embodiment of the utility vest of the present invention.

In accordance with the invention, and as depicted in FIGS. 1 and 2, the utility vest includes a sleeveless vest broadly denoted as 10, having front panels 11,12, side panels 13,14, back panel 15, and shoulder panels 16,17 connecting each of front panels 11,12 to back panel 15. Sleeveless vest 10 can be any of a wide variety of commercially available sleeveless vests presently known. The sleeveless vest 10 can be made of any lightweight, strong material and is characterized by lightness of weight, strength, and coolness in hot weather. The preferred material for the sleeveless vest 10 is nylon, most preferably nylon mesh.

In accordance with the invention, the utility vest is provided with front panel closing means connected to the front panels for closing and opening the front panels of the vest. As here embodied, and as depicted in FIG. 1, the front panel closing means comprises a zipper 18 sewn to the front panels. Of course, any means for closing and opening the vest, e.g., buttons or Velcro hook and mesh strips sewn to the front panels, may be used as the front panel closing means.

The utility vest of the present invention is also provided with a utility apron 19. Utility apron 19 can be made of any cloth material that is durable, strong, and lightweight, such as canvas, which is preferred.

In accordance with the invention, the utility vest is provided with a utility apron connecting means located beneath the front panel closing means and attached to and around the lower periphery of the vest panels and to the top of the utility apron for detachably connecting the utility apron to and around the lower periphery of the vest panels. As here embodied, and as depicted in FIGS. 1 and 2, the utility apron connecting means comprises a heavy duty zipper 20 sewn to the bottom of the sleeveless vest 10 and to the top of the utility apron 19. Accordingly, the utility apron 19 is detachably connected to the bottom of the panels 11-15. The large heavy-duty zippers used commercially on military field jackets are well-suited for use as the utility apron connecting means.

In accordance with the invention, the utility vest of the present invention is also provided with a plurality of pouches adapted to hold tools and supplies of various kinds. The exact number, design, size, and location of the pouches varies according to the particular needs of the worker using the vest. As here embodied, and as shown in the drawings, there are provided large utility pouches 21 for a speed square, larger nails, 100 foot tape measure, wrench, etc.; chalk box and hammer loops 22; screw driver and pocket knife pouches 23; small utility pouches 24 for nails, screws, nuts, bolts, washers, etc.; holder 25 for retractable tape measure; and folding rule, pliers, and utility knife pouches 26. Pouches 21–26 can be made of any rugged and durable material such as leather.

Further in accordance with the invention, the utility vest is provided with pouch connecting means attached to the utility apron at desired locations and to the top of each pouch for detachably and interchangeably connecting each pouch to the utility apron at the desired location. As here embodied, and as depicted in the drawings, the pouch connecting means comprise heavy-duty zippers 27,28,29,30,31 sewn to the top of each pouch and on the utility apron 19. Each of zippers 27–31 is designed so that any pouch can be zipped onto the utility apron 19 at any zipper location. Thus, workers can arrange their pouches, tools, and equipment as they please, and all repairmen, electricians, plumbers, carpenters, and other workers requiring a number of various tools at their fingertips are accomodated. Again, the type of heavy-duty zipper used on military field jackets is well-suited for use as the pouch connecting means.

In accordance with the invention, the utility vest is also provided with buckle means located beneath the utility apron closing means and attached to each end of the utility apron for detachably securing the ends of the utility apron. As embodied herein and depicted in FIG. 1, the buckle means comprises a buckle 32. Buckle 32 eliminates unnecessary strain on the vest zipper 18 and facilitates a proper weight distribution between the hips and shoulders. Accordingly, the need for padding the shoulder panels 16,17 is eliminated.

In accordance with the invention, breast pockets 33,34 are also provided for the retention of pencils, lumber crayons, ball point pens, and felt tip pens. As depicted in FIG. 1, these pockets are so placed that spilling or breaking of their contents is avoided during bending, squatting, or lifting heavy objects against the body.

It will be appreciated that by detachably mounting the utility apron to the bottom of the sleeveless vest, the apron can be removed and the vest washed. Moreover, the tools carried by the apron pouches are lowered closer to the level of sawhorses and work benches than work aprons now known. This arrangement also places the tools closer to the hands of the worker, thus requiring less bending of the elbows and less time to obtain and restore tools from and to the utility apron.

Bearing in mind that construction workers are outside in various weather conditions, it will be appreciated that the utility vest of the present invention also allows the worker to wear a short coat, e.g., a waist-length jacket, over the sleeveless vest and still have unlimited access to all tool pouches.

It will be apparent to those skilled in the art that various modifications and variations can be made in the utility vest of the present invention without departing from the scope or spirit of the invention. Thus, it is intended that the present invention cover the modifications and variations of this invention provided that they come within the scope of the appended claims and their equivalents.

What is claimed is:

1. A utility vest comprising a sleeveless vest made of a lightweight, strong material having an integral body comprising a back panel, two side panels, two front panels and a shoulder panel connecting each front panel to the back panel;

front panel closing means connected to the front panels for closing and opening the front panels of the vest;

a utility apron made of a cloth material;

utility apron connecting means located beneath the front panel closing means and attached to and around the lower periphery of the vest panels and to the top of the utility apron for detachably connecting the utility apron to and around the lower periphery of the vest panels;

a plurality of pouches adapted to hold tools and supplies of various kinds;

pouch connecting means attached to the utility apron at desired locations and to the top of each pouch for detachably and interchangeably connecting each pouch to the utility apron at the desired locations; and buckle means located beneath the utility apron connecting means and attached to each end of the utility apron for detachably securing the ends of the utility apron.

2. A utility vest as set forth in claim 1 wherein the sleeveless vest is made of nylon mesh, the utility apron is made of canvas, and the pouches are made of leather.

3. A utility vest as set forth in claim 1 wherein the utility apron connecting means comprises a zipper having one side attached to and around the top of the utility apron and another side attached to and around the lower periphery of the vest panels.

4. A utility vest as set forth in claim 1 wherein the pouch connecting means comprise a plurality of zippers.

5. A utility vest as set forth in claim 1 wherein the front panel connecting means comprises a zipper.

6. A utility vest as set forth in claim 1 wherein the utility apron is so disposed about the lower periphery of the vest panels as to provide unhindered access to the contents of said plurality of pouches beneath an outergarment worn over the utility vest.

* * * * *